United States Patent [19]

Chundelak, Jr.

[11] 4,241,249

[45] Dec. 23, 1980

[54] PULL CHAIN ATTACHMENT FOR ROTARY LIGHT SWITCH

[76] Inventor: Louis W. Chundelak, Jr., 13725 NE. Fremont Ct., Portland, Oreg. 97230

[21] Appl. No.: 942,321

[22] Filed: Sep. 14, 1978

[51] Int. Cl.[3] ..... H01H 17/06

[52] U.S. Cl. ..... 200/161; 200/331

[58] Field of Search ..... 200/153 F, 161, 329, 200/330, 331, 336, 338

[56] References Cited

U.S. PATENT DOCUMENTS

| | | | |
|---|---|---|---|
| 984,053 | 2/1911 | Weber, Sr. | 200/161 |
| 1,264,762 | 4/1918 | Biscayart et al. | 260/331 |
| 1,264,763 | 4/1918 | Biscayart et al. | 200/331 |
| 1,289,557 | 12/1918 | Searles | 200/331 |
| 3,643,052 | 2/1972 | Marshall, Jr. | 200/161 |

FOREIGN PATENT DOCUMENTS

| | | | |
|---|---|---|---|
| 823000 | 11/1951 | Fed. Rep. of Germany | 200/161 |
| 643672 | 5/1964 | France | 200/161 |

*Primary Examiner*—Richard R. Stearns
*Attorney, Agent, or Firm*—Oliver D. Olson

[57] ABSTRACT

The thumb wheel rotary shaft of an electric lamp socket switch is connected detachably to the first of a pair of rotary clutch members the second of which is connected to a pull chain for rotation in one direction against the resilient resistance of a spring. Releasable coupling between the clutch members operates to connect them together for simultaneous rotation when the second clutch member is rotated by the pull chain. The clutch members and inner portion of the length of pull chain are contained within a housing which is pivotable about the axis of the clutch members, and a pair of stop members on the housing are arranged to engage the second clutch member to establish the limits of its rotation between retracted and extended positions of the pull chain.

11 Claims, 6 Drawing Figures

PULL CHAIN ATTACHMENT FOR ROTARY LIGHT SWITCH

BACKGROUND OF THE INVENTION

This invention relates to electric lamp socket switches of the rotary type, and more particularly to an external attachment by which electric lamp socket switches of the rotary thumb wheel type are rendered operable by a pull chain.

There are a variety of commercially available electric lamp socket switches which are constructed internally for operation by a pull chain. They are convenient for use in table and floor lamps since the pull chain is disposed for ready access. However, they involve the assembly of a considerable number of parts and therefore are expensive to manufacture and are susceptible of malfunction after limited use.

There also are a variety of commercially available electric lamp socket switches which are constructed internally for operation by a horizontal rotary shaft extending laterally from the socket housing and fitted at its exposed end with a thumb wheel for manual operation. They involve significantly fewer parts than the pull chain type and therefore are less expensive and have considerably longer service life. However, the thumb wheel generally is located in a position, such as under a lamp shade, of difficult or inconvenient accessibility.

U.S. Pat. No. 3,643,052 discloses an operator capable of attachment to the horizontal rotary shaft of an electric lamp socket switch, in place of the thumb wheel, for operating the shaft by a pull chain.

SUMMARY OF THE INVENTION

In its basic concept, this invention provides a pull chain attachment for the thumb wheel rotary shaft of an electric lamp socket switch, the attachment including a pair of rotary clutch members contained within a housing with one of the clutch members mounting the housing for relative rotation and being adapted for connection to the rotary shaft of the lamp socket switch, the other of the clutch members being rotatable between retracted and extended positions of a pull chain.

It is by virtue of the foregoing basic concept that the principal objective of this invention is achieved; namely, to overcome the aforementioned disadvantages and limitations of prior pull chain operators for electric lamp socket switches.

Another objective of this invention is the provision of a pull chain attachment of the class described which permits pulling of the pull chain in a variety of planes other than vertical.

A further objective of this invention is the provision of a pull chain attachment of the class described which is adapted for use with electric lamp socket switches having thumb wheel rotary shafts provided with threaded outer ends of different diameters.

Still another objective of this invention is the provision of a pull chain attachment of the class described which also enables manipulation of the switch by an auxiliary thumb wheel.

A still further objective of this invention is the provision of a pull chain attachment of the class described which is of simplified construction for economical manufacture, is attachable and detachable with speed and facility and is capable of long service life with minimum maintenance.

The foregoing and other objects and advantages of this invention will appear from the following detailed description taken in connection with the accompanying drawings of preferred embodiments.

DESCRIPTION OF THE PREFERRED EMBODIMENT

Figure 1:
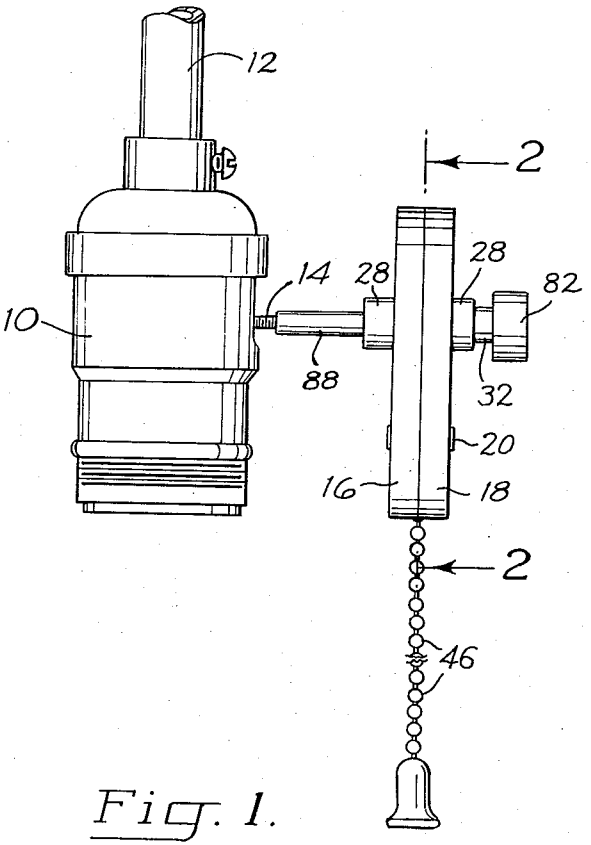
FIG. 1 is a fragmentary vertical elevation showing a conventional electric lamp socket switch of the rotary thumb wheel type having substituted for the thumb wheel thereof a pull chain attachment embodying the features of this invention.

FIG. 1 illustrates a conventional electric lamp socket switch 10 of the thumb wheel rotary shaft type. It is shown connected to the bottom end of a hollow tube 12 through which electrical conductors are led from the lamp socket to a source of electric potential. The arrangement illustrated is typical of lamps of the swag type wherein the light bulb depends downwardly from a supporting chain. It will be understood, of course, that the lamp socket and tube arrangement illustrated may be inverted, with the socket facing upward, in the manner of use in table and floor lamps.

In accordance with this invention, the thumb wheel normally provided at the outer end of the rotary shaft 14 which extends horizontally outward from the lamp socket switch, is removed and replaced by the pull chain attachment of this invention.

Figure 2:
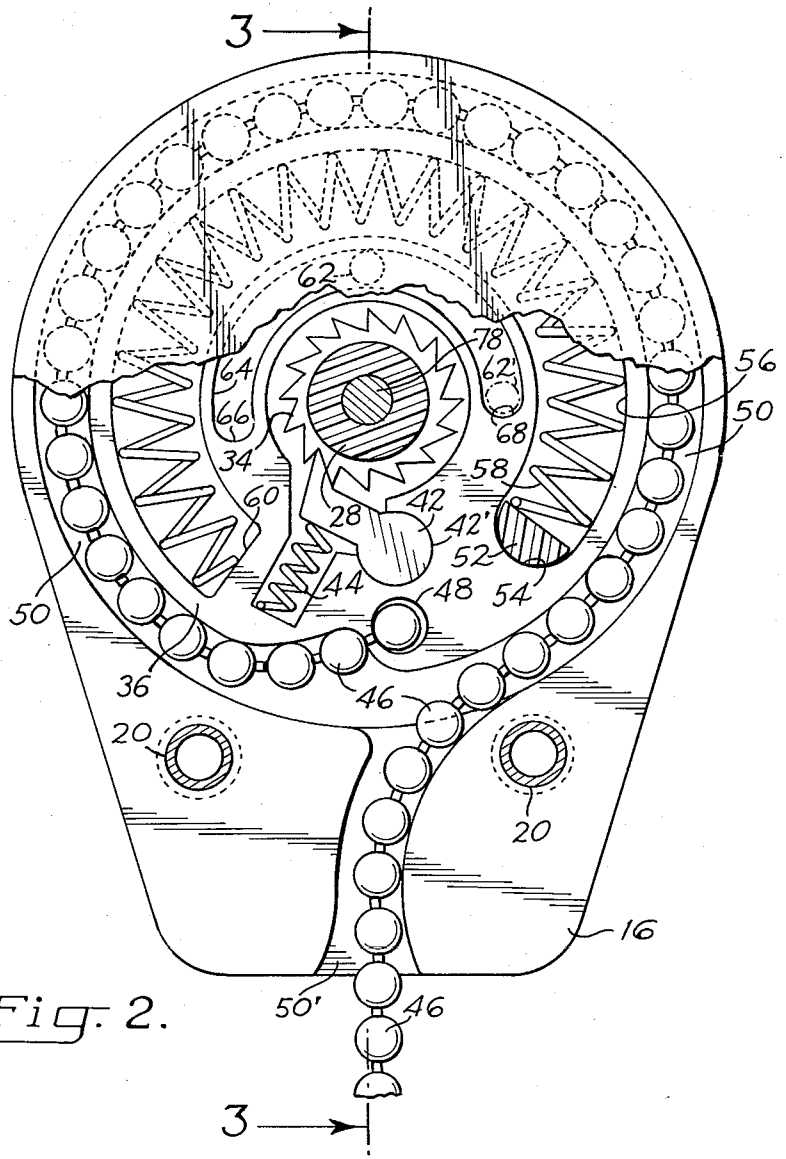
FIG. 2 is a fragmentary vertical section taken on the line 2—2 in FIG. 1.
Figure 3:
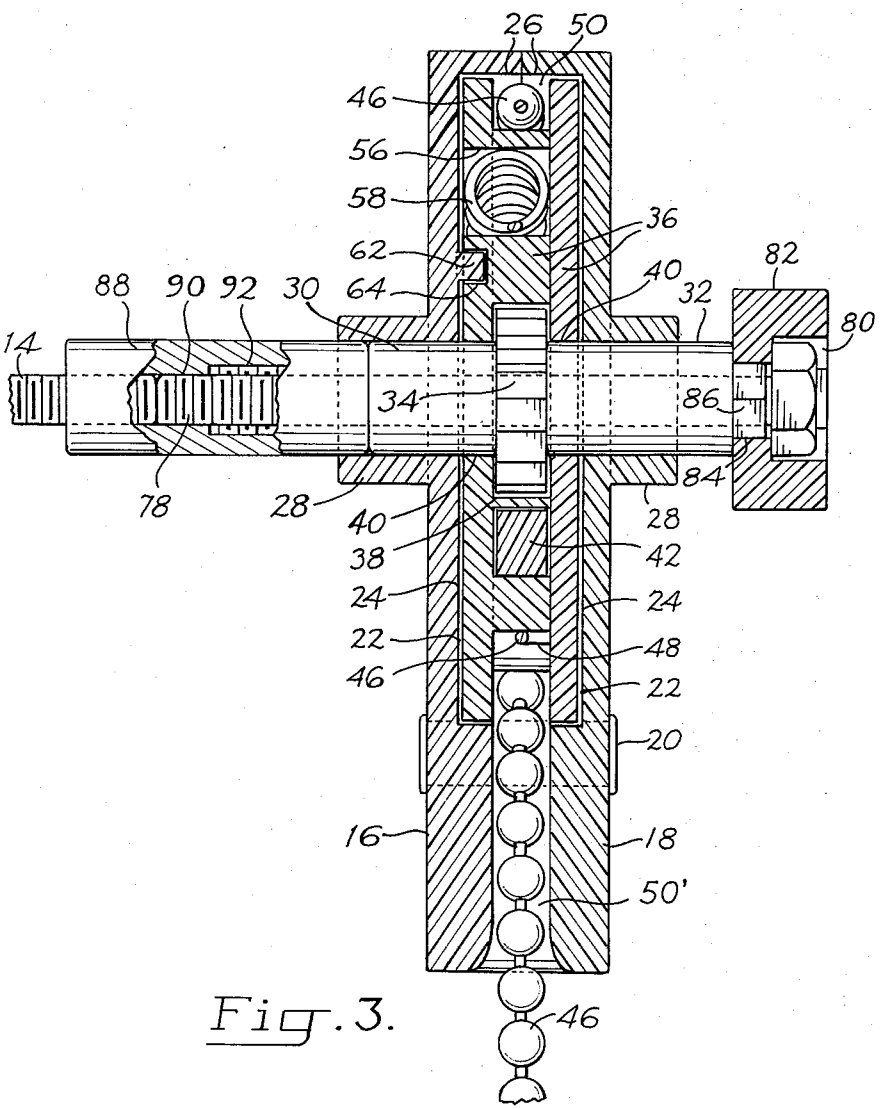
FIG. 3 is a fragmentary vertical section taken on the line 3—3 in FIG. 2.

In the embodiment illustrated in FIGS. 2 and 3 of the drawings, the pull chain attachment includes a hollow housing formed of two lateral halves 16 and 18. In the assembled condition of the attachment, these halves are secured together by any suitable means, such as the hollow rivets 20 illustrated.

The hollow housing forms an internal chamber 22 defined by the end wall 24 and outer circular wall 26 in each of the housing halves. Openings through the sides of the housing, co-axial with the axial center of the chamber, are extended laterally outward by means of the laterally projecting annular bosses 28. The openings through the housing receive rotatably therein the hubs 30 and 32 projecting laterally to opposite sides of a ratchet gear 34. The ratchet gear is made integral with or otherwise secured to the hubs.

The ratchet gear forms one component of a rotary clutch. The second component of the clutch is in the form of a circular plate 36 made of two circular sections glued or otherwise secured together. At its axial center, the plate is provided with a stepped circular opening the larger diameter portion 38 of which is slightly larger than the diameter of the ratchet gear and the smaller diameter portions 40 of which freely receive the hubs 30 and 32 therethrough.

A ratchet pawl 42 is mounted pivotally at one end in a socket 42' provided in the clutch plate 36, and the opposite end is arranged for releasable engagement with the teeth of the ratchet gear. A coil spring 44, disposed in a pocket in the clutch plate, engages the pawl and urges the latter resiliently toward the ratchet gear. The arrangement is such that clockwise rotation of the clutch plate (FIG. 2) causes the pawl to engage the ratchet gear and rotate the latter clockwise with the clutch plate. However, counterclockwise rotation of the clutch plate allows the pawl to move outwardly against the resistance of the spring 44 and thus disengage the ratchet gear 34 from the clutch plate 36.

Rotation of the clutch plate is provided by a pull chain 46. The inner end of the pull chain is anchored to the clutch plate by any suitable means. In the embodiment illustrated, the pull chain is provided in the form of a multiplicity of spherical beads joined together at spaced intervals by short lengths of rod. Thus, connection of the chain to the clutch plate is provided by a key-hole shape socket 48 formed in one face of the clutch plate.

The outer periphery of the clutch plate 36 is provided with an annular groove 50. The outer circumference of the clutch plate 36 is disposed adjacent the peripheral wall 26, whereby the outer side of the groove is substantially closed by the wall 26. The groove thus forms an arcuate guide passageway and retainer for the inner portion of a length of pull chain 46. As illustrated in FIG. 2, the pull chain extends from its anchored end clockwise through the guide passageway 50 for substantially 360°. The guide passageway registers with an outlet passageway 50' formed in the sections of the housing. The pull chain thus extends from the guide passageway 50 through the outlet passageway 50' from whence it hangs downward by gravity for grasping by the hand.

Means is provided for limiting the rotation of the clutch plate 36 between predetermined positions of retraction and extension of the pull chain relative to the housing. FIG. 2 illustrates the position of retraction, and this is defined by abutment of a post 52 with the leading end 54 of an arcuate slot 56, i.e. the end leading in the direction of rotation of the clutch plate during extension of the pull chain. The post is secured to one section of the housing and extends freely into the slot, as illustrated.

Means also is provided for urging the clutch plate 36, and hence the pull chain, to this position of retraction. To this end, an elongated coil spring 58 is confined within the arcuate slot 56, bearing at one end against the post 52 and at the opposite end against the opposite, trailing end 60 of the slot. By this arrangement the clutch plate is urged to rotate counterclockwise to the position of pull chain retraction illustrated in FIG. 2.

The position of extension of the pull chain is defined, in the embodiment illustrated, by a second post 62 which is secured to one section of the housing and extends freely through a second arcuate slot 64 in the clutch plate. The end 66 of the second arcuate slot trailing in the direction of rotation of the clutch plate during extension of the pull chain, is arranged to abut the post 62 at the desired position of rotation of the clutch plate, and hence the correspondingly desired degree of extension of the pull chain.

Referring to FIGS. 2 and 3 of the drawings, the post 62 illustrated is displaced from the trailing end 66 of the second slot by about 90°. Thus, the pull chain may be extended from the housing until the clutch plate has rotated clockwise about 90° from the position illustrated in FIG. 2, against the resistance of the retracting spring 58, until the trailing end 66 of the second slot abuts the post 62. This arrangement is suitable for use of the pull chain attachment with electric socket switches of the three-way type, since the latter requires the stepping to four positions displaced 90° apart to accommodate switching a three-way lamp between the positions of "off", "low", "medium" and "high" intensities.

FIG. 2 also illustrates in broken line an alternative position 62' for the post. It is displaced from the trailing end 66 of the second slot 64 by about 180°. This arrangement is suitable for use with electric lamp socket switches of the two-way type which merely require switching through the two positions of "off" and "on".

It is to be noted that the alternative position 62' for the post coincides with the leading end 68 of the second slot in the clutch plate. Thus, in this position the post may serve the additional function of defining the limit of counterclockwise rotation of the clutch plate to the retracted position of the pull chain. In this manner, the post 52 which forms an abutment for the retractor spring 58 need not be arranged to abut the leading end 54 of the arcuate slot 56 which contains the retractor spring.

Figure 6:
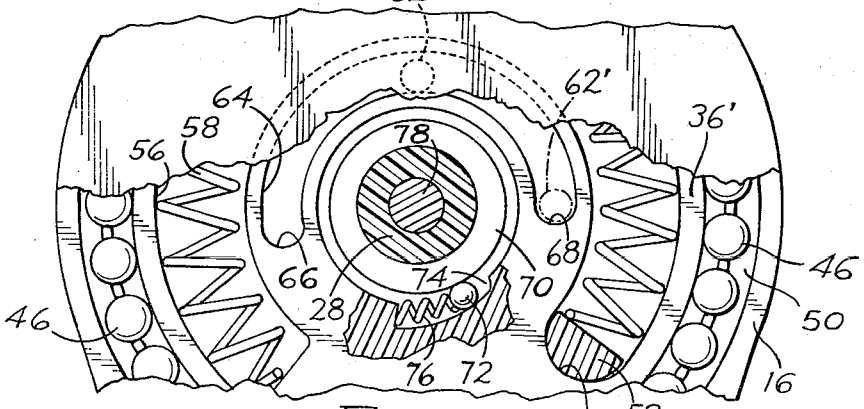
FIG. 6 is a fragmentary vertical section, similar to FIG. 2, showing an alternative form of clutch mechanism forming a part of the pull chain attachment of this invention.

FIG. 6 illustrates another form of rotary clutch which may substitute for the ratchet and pawl type clutch described hereinbefore. In the embodiment of FIG. 6, the ratchet gear 34 previously described is replaced by a cylindrical clutch member 70. The previously described pawl 42 is replaced by a spherical or cylindrical roller 72 which is confined within a cam pocket 74 formed in the inner surface of the clutch plate 36' facing the cylindrical member 70. The spherical or cylindrical roller functions as a wedging member between the clutch components. Thus, the cam pocket 74 increases in depth, relative to the surface of the cylindrical member 70, in the clockwise direction as illustrated in FIG. 6. Further, the roller is urged resiliently, as by means of the backing spring 76, toward the shallower end of the cam pocket where it becomes wedged between the bottom of the cam pocket and the confronting surface of the cylindrical clutch member 70.

In operation, when the pull chain 46 is extended from the housing, causing the clutch plate 36' to rotate clockwise, the wedging roller 72 is caused to roll along the cam pocket counter-clockwise toward the shallow end where it becomes wedged between the cam pocket and the cylindrical clutch member. The two clutch components thus are coupled together for simultaneous rotation in the clockwise direction of FIG. 6. Upon release of the pull chain, the retractor spring 58 urges the clutch plate 36' into counter-clockwise rotation. The wedging roller thus is caused to roll, clockwise in FIG. 6, into the deeper portion of the cam pocket and out of wedging contact with the cylindrical clutch member. The latter thus is disengaged from the clutch plate 36'.

It will be appreciated that the clutch arrangement illustrated in FIG. 6 affords the advantage of an infinite number of positions of coupling together of the clutch components, as distinguished from the discreet number of coupling positions afforded by the ratchet gear and pawl arrangement illustrated in FIG. 2. However, the latter arrangement has the advantage of more positive coupling.

Means is provided for connecting the first clutch member 34 or 70 to the threaded end portion of the thumb wheel rotary shaft 14 of the electric lamp socket switch 10. Referring to FIG. 3 of the drawings, the assembly of hubs 30 and 32 and ratchet gear 34 is provided with an axial bore for the removable reception of an elongated screw 78. The non-circular headed end of the screw preferably is received within a correspondingly non-circular opening 80 in the outer side of an auxiliary thumb wheel 82. The inner side of the thumb wheel is provided with a non-circular opening 84 arranged to receive a correspondingly non-circular extension 86 on the end of hub 32. Thus, the thumb wheel 82, ratchet 34 and screw 78 are coupled together for simultaneous rotation. It will be apparent that this auxiliary thumb wheel may be omitted and the headed end of the screw brought into abutment with the confronting end of the hub 32. However, the auxiliary thumb wheel facilitates attachment of a spacer adapter now to be described.

The opposite end of the elongated screw 78 projects beyond the end of the opposite hub 30 and housing boss 28, for threaded connection to a spacer adapter 88. In FIG. 3, the spacer adapter is a hollow sleeve provided with a stepped bore one section 90 of which is formed with an internal thread matching the thread of the screw 78. As illustrated, this thread also matches the threaded outer end of the thumb wheel rotary shaft 14. The other section 92 of the stepped bore is of larger diameter and is threaded for attachment of a shaft 14 of correspondingly larger diameter. In either case, the sleeve serves as a threaded connection for both the screw 78 and shaft 14, and it also functions to space the pull chain attachment laterally outward from the lamp socket 10 (FIG. 1) to position the pull chain 46 away from a light bulb in the socket.

The sleeve 88 is secured to the screw 78 by rotating the sleeve relative to the screw, or by rotating the screw, by the auxiliary thumb wheel 82. The latter also may be used to rotate the clutch member 34 or 70, if desired.

Figure 4:
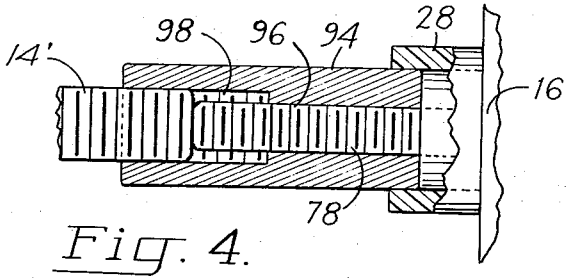
FIGS. 4 and 5 are fragmentary sectional views illustrating the manner in which the pull chain attachment of this invention is coupled to the threaded outer ends of thumb wheel rotary shafts of different diameters.

The thumb wheel rotary shaft 14 of conventional electric lamp socket switches presently are of three different diameters. The shaft 14 illustrated in FIG. 3 is the smallest diameter, whereas the shaft 14' illustrated in FIG. 4 is the largest diameter. For this latter purpose a spacer adapter 94 is provided with a stepped bore the smaller diameter section 96 of which is threaded to match the threads of the connecting screw 78 and the larger section 98 is threaded to match the threads of the largest diameter thumb wheel rotary shaft 14'. The section 92 of adapter 88 is proportioned for attachment of a rotary shaft of intermediate diameter, as will be understood.

Figure 5:
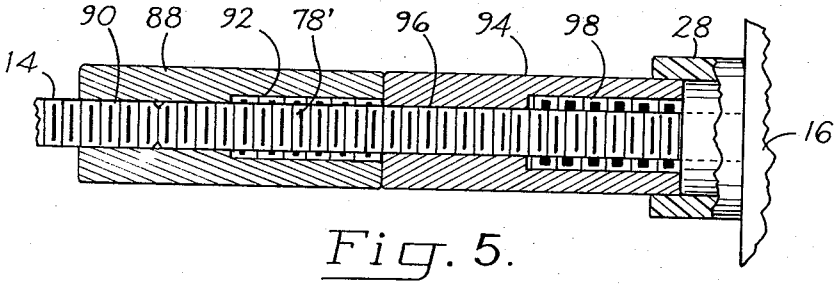

FIG. 5 illustrates the use of both of the spacer sleeves 88 and 94 shown in FIGS. 3 and 4, in order to space the pull chain attachment still farther outward from the lamp socket 10. For this purpose the connecting screw 78' is provided in a greater length so as to extend completely through the inner sleeve 94 and about three-fourths through the outer sleeve 88 to which the threaded end of the thumb wheel rotary shaft 14 is attached. In the embodiment illustrated, the thumb wheel rotary shaft is of the smallest diameter type illustrated in FIG. 3. In the event the shaft 14' of the largest diameter type of FIG. 4 is used, the two sleeves would be inverted from the position illustrated in FIG. 5, as will be understood.

It is to be noted that the housing is pivoted freely upon the hubs 30 and 32 of the first or inner clutch component 34 or 70. Accordingly, the housing may be swung about the axis of the thumb wheel rotary shaft 14 of the socket switch during manipulation of the pull chain. This affords pulling of the chain in any direction about a circle disposed in a plane parallel to the housing, to accommodate the convenience of the user. Moreover, the pull chain may be pulled in a plane which is disposed at an acute angle to the plane of the housing. For this purpose the outer end of the outlet passageway 50' is flared (FIGS. 2 and 3) to accommodate angular displacement of the pull chain in substantially all directions relative to the housing.

It will be apparent to those skilled in the art that various changes may be made in the size, shape, type, number and arrangement of parts described hereinbefore without departing from the spirit of this invention.

Having now described my invention and the manner in which it may be used, I claim:

1. A pull chain attachment for an electric lamp socket switch having a thumb wheel rotary shaft, comprising:

(a) a hollow housing having a chamber therein, (b) first and second rotary clutch members in the chamber, operable in one direction of rotation of the second clutch member to be coupled together for simultaneous rotation, (c) connecting hub means on the first rotary clutch member extending axially therefrom through the housing for detachable connection to the thumb wheel rotary shaft of an electric lamp socket switch, and for mounting the housing for pivotal movement freely relative to the first rotary clutch member and thumb wheel rotary shaft and lamp socket, (d) the second rotary clutch member being disposed in the housing chamber to form between them an arcuate pull chain guide passageway, (e) the housing having a pull chain outlet passageway communicating with the guide passageway, (f) an elongated pull chain secured at its inner end to the second rotary clutch member and extending therefrom through the guide and outlet passageways, for rotating the second rotary clutch member from a pull chain retracted position to a pull chain extended position, and (g) retractor means engaging the second rotary clutch member for rotating it to said pull chain retracted position.

2. The pull chain attachment of claim 1 including stop means on the housing arranged to engage the second rotary clutch member for defining the limits of rotation of the latter between retracted and extended positions of the pull chain relative to the housing.

3. The pull chain attachment of claim 2 wherein the stop means comprises at least one projection on the housing arranged to engage spaced abutments on the second clutch member.

4. The pull chain attachment of claim 2 wherein the stop means comprises a projection on the housing received freely in an arcuate slot in the second clutch member and arranged to abut one end of the slot to define said retracted position of the pull chain and to abut the opposite end of the slot to define said extended position of the pull chain.

5. The pull chain attachment of claim 2 wherein the stop means includes a projection on the housing arranged to engage an abutment on the second clutch member when the second clutch member is rotated about 90° from said retracted position.

6. The pull chain attachment of claim 2 wherein the stop means includes a projection on the housing arranged to engage an abutment on the second clutch member when the second clutch member is rotated about 180° from said retracted position.

7. The pull chain attachment of claim 1 including a thumb wheel secured to the hub means for rotating the first clutch member.

8. A pull chain attachment for an electric lamp socket switch having a thumb wheel rotary shaft, comprising:

(a) a hollow housing having a chamber therein, (b) first and second rotary clutch members in the chamber, operable in one direction of rotation of the second clutch member to be coupled together for simultaneous rotation, (c) connecting means on the first rotary clutch member extending axially therefrom through the housing for detachable connection to the thumb wheel rotary shaft of an electric lamp socket switch, (d) the second rotary clutch member being disposed in the housing chamber to form between them an arcuate pull chain guide passageway, (e) the housing having a pull chain outlet passageway communicating with the guide passageway, (f) an elongated pull chain secured at its inner end to the second rotary clutch member and extending therefrom through the guide and outlet passageways for rotating the second rotary clutch member from a pull chain retracted position to a pull chain extended position, (g) retractor means engaging the second rotary clutch member for rotating it to said pull chain retracted position, and (h) releasable coupling means comprising a wedging member retained in a cam pocket in the face of one of the clutch members facing the other clutch member, the wedging member being operable upon rotation of the second clutch member by the pull chain to secure the clutch members together for simultaneous rotation, the wedging member being operable upon rotation of the second clutch member in the opposite direction by the retractor means to disconnect the clutch members from each other.

9. A pull chain attachment for an electric lamp socket switch having a thumb wheel rotary shaft, comprising:

(a) a hollow housing having a chamber therein, (b) first and second rotary clutch members in the chamber, operable in one direction of rotation of the second clutch member to be coupled together for simultaneous rotation, (c) connecting means on the first rotary clutch member extending axially therefrom through the housing for detachable connection to the thumb wheel rotary shaft of an electric lamp socket switch, (d) the second rotary clutch member being disposed in the housing chamber to form between them an arcuate pull chain guide passageway, (e) the housing having a pull chain outlet passageway communicating with the guide passageway, (f) an elongated pull chain secured at its inner end to the second rotary clutch member and extending therefrom through the guide and outlet passageways for rotating the second rotary clutch member from a pull chain retracted position to a pull chain extended position, (g) retractor means engaging the second rotary clutch member for rotating it to said pull chain retracted position, and (h) stop means on the housing arranged to engage the second rotary clutch member for defining the limits of rotation of the latter between retracted and extended positions of the pull chain relative to the housing, the stop means comprising a first projection on the housing received freely in a first arcuate slot in the second clutch member and arranged to abut one end of the first slot to define said retracted position of the pull chain, and a second projection on the housing received freely in a second arcuate slot in the second clutch member and arranged to abut one end of the second slot to define said extended position of the pull chain.

10. The pull chain attachment of claim 9 wherein the retractor means comprises a spring disposed in and abutting one end of the said first arcuate slot in the second clutch member, and the first projection on the housing is arranged for abutment of the opposite end of the spring.

11. A pull chain attachment for an electric lamp socket switch having a thumb wheel rotary shaft, comprising:

(a) a hollow housing having a chamber therein, (b) first and second rotary clutch members in the chamber, operable in one direction of rotation of the second clutch member to be coupled together for simultaneous rotation, (c) connecting means on the first rotary clutch member extending axially therefrom through the housing for detachable connection to the thumb wheel rotary shaft of an electric lamp socket switch, (d) the second rotary clutch member being disposed in the housing chamber to form between them an arcuate pull chain guide passageway, (e) the housing having a pull chain outlet passageway communicating with the guide passageway, (f) an elongated pull chain secured at its inner end to the second rotary clutch member and extending therefrom through the guide and outlet passageways for rotating the second rotary clutch member from a pull chain retracted position to a pull chain extended position, and (g) retractor means engaging the second rotary clutch member for rotating it to said pull chain retracted position, the retractor means comprising a spring disposed in and abutting one end of an arcuate slot in the second clutch member, and a projection on the housing received freely in the slot for abutment of the opposite end of the spring.

* * * * *